US006266028B1

(12) United States Patent
Schmidt et al.

(10) Patent No.: US 6,266,028 B1
(45) Date of Patent: Jul. 24, 2001

(54) ANTENNA LENS FOR A DISTANCE SENSOR

(75) Inventors: Ewald Schmidt, Ludwigsburg; Bernhard Lucas, Besigheim, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/339,455

(22) Filed: Jun. 24, 1999

(30) Foreign Application Priority Data

Jul. 2, 1998 (DE) ..... 198 29 554

(51) Int. Cl.[7] ..... H01Q 15/02
(52) U.S. Cl. ..... 343/909; 343/753; 343/911 R
(58) Field of Search ..... 343/909, 713, 343/753, 872, 911 R, 911 L, 910; H01Q 15/02

(56) References Cited

U.S. PATENT DOCUMENTS 1,812,695 * 6/1931 Harms ..... 343/909
3,188,642 * 6/1965 Bock et al. ..... 343/756
3,673,606 * 6/1972 Maune ..... 343/766
3,972,043 * 7/1976 Lotus ..... 343/18 B
4,318,108 * 3/1982 Yukl ..... 343/753
4,757,323 * 7/1988 Duret et al. ..... 343/756
5,764,199 * 6/1998 Ricardi ..... 343/911 R

FOREIGN PATENT DOCUMENTS 196 44 164 4/1998 (DE) .
197 24 320 12/1998 (DE) .

* cited by examiner

*Primary Examiner*—Don Wong
*Assistant Examiner*—Trinh Vo Dinh
(74) *Attorney, Agent, or Firm*—Kenyon & Kenyon

(57) ABSTRACT

An antenna lens for a distance sensor, there being recessed on one side of a lens base element grooves into which are placed electrically conductive traces which are encapsulated into the grooves. The electrically conductive traces are passed through the grooves over the edge of the lens base element and fastened.

20 Claims, 4 Drawing Sheets

ANTENNA LENS FOR A DISTANCE SENSOR

FIELD OF THE INVENTION

The present invention relates to an antenna lens for a distance sensor, there being recessed on one side of a lens base element grooves into which are placed electrically conductive traces which are encapsulated into the grooves. Distance sensors can be used in particular for motor vehicles, for example in the context of an automatic distance warning system, a pre-crash detection device, or an adaptive vehicle speed control system.

BACKGROUND INFORMATION

German Patent Application No. 96 44 164 describes a dielectric element which is located in the beam path of the radar system and possesses at least one arrangement made up of electrically conductive traces. The arrangement is to be dimensioned and/or arranged such that its effect on the beam path of the electromagnetic waves is negligible. This is achieved by the fact that the arrangement has conductive traces whose width is no more than $\lambda/10$ and whose spacings from one another are at least $\lambda/4$, $\lambda$ denoting the free-space wavelength of the electromagnetic waves being used. The conductive traces themselves should extend largely perpendicular to the polarization plane of the radiated or received waves.

Also described is the possibility of dividing the electrically conductive arrangement into at least two portions separated from one another, so that the electrical resistance and capacitance between the two separate portions can be measured. These two variables contribute to the so-called loss angle tan $\delta$ of the coating material, which allows conclusions to be drawn regarding the magnitude of any soiling or of a coating on the dielectric element.

Thick-film technology in the case of elements made of ceramic, and known printing methods in the case of plastic elements, are cited as possibilities for manufacturing the electrically conductive arrangement on the dielectric element.

Nothing is set forth in German Patent Application No. 1 96 44 164 regarding the manufacture of electrically conductive traces which run within a dielectric element.

German Patent Application No. 1 97 24 320 describes a heatable antenna lens made up of a dielectric element which possesses therein an arrangement of electrically conductive traces. The lens is configured such that the electrically conductive arrangement does not lie in one plane, and such that the electrically conductive arrangement is; arranged close to the convex external surface of the lens. Attachment of the heating contacts is accomplished through holes in the lens base element. The material indicated for the lens is preferably a thermoplastic such as polycarbonate or polyethylene.

A two-stage injection process is set forth for manufacture of the lens. In this, a lens base element with a groove preferably of continuously meandering shape is first injection-molded. A resistance wire is placed into this continuous groove. This intermediate assembly is then injection-coated with a surface layer, preferably made of the same material as the lens.

A disadvantage of German Patent Application No. 197 24 320 is that the electrically conductive traces that are laid in place can slip during the second injection-molding operation. If the intended position of the electrically conductive traces were to change under the injection-molding pressure, subsequent overheating and damage to the plastic, and possibly to the wire, at those points would be possible.

SUMMARY OF THE INVENTION

It is accordingly an object of the present invention to provide an antenna lens for a distance sensor into which electrically conductive traces are introduced in such a way that their position within the antenna lens is exactly defined.

According to the present invention, the electrically conductive traces are placed into grooves in the lens base element, passed over the edge of the lens base element, and held in their position with fastening elements.

An advantage of the antenna lens according to the present invention is that the electrically conductive traces are held in their position by the fastening elements in such a way that when the lens base element is injection-coated, no further slippage is possible. The danger of later overheating and damage to the plastic and possibly to the electrically conductive traces, due to incorrect positioning of the electrically conductive traces, is thus eliminated.

Advantageously, fastening elements in the form of projections on the outer edge of the lens base element, fastening elements on the side of the lens base element facing away from the grooves, and clamping elements on the side of the lens base element facing away from the grooves, are present. These fastening elements and clamping elements securely hold and clamp the electrically conductive traces in the desired position. If the various fastening elements are located at different distances from the center of the lens base element, this non-intersecting placement of the electrically conductive traces prevents any electrical short-circuit due to mutual contact.

DETAILED DESCRIPTION

Figure 1:
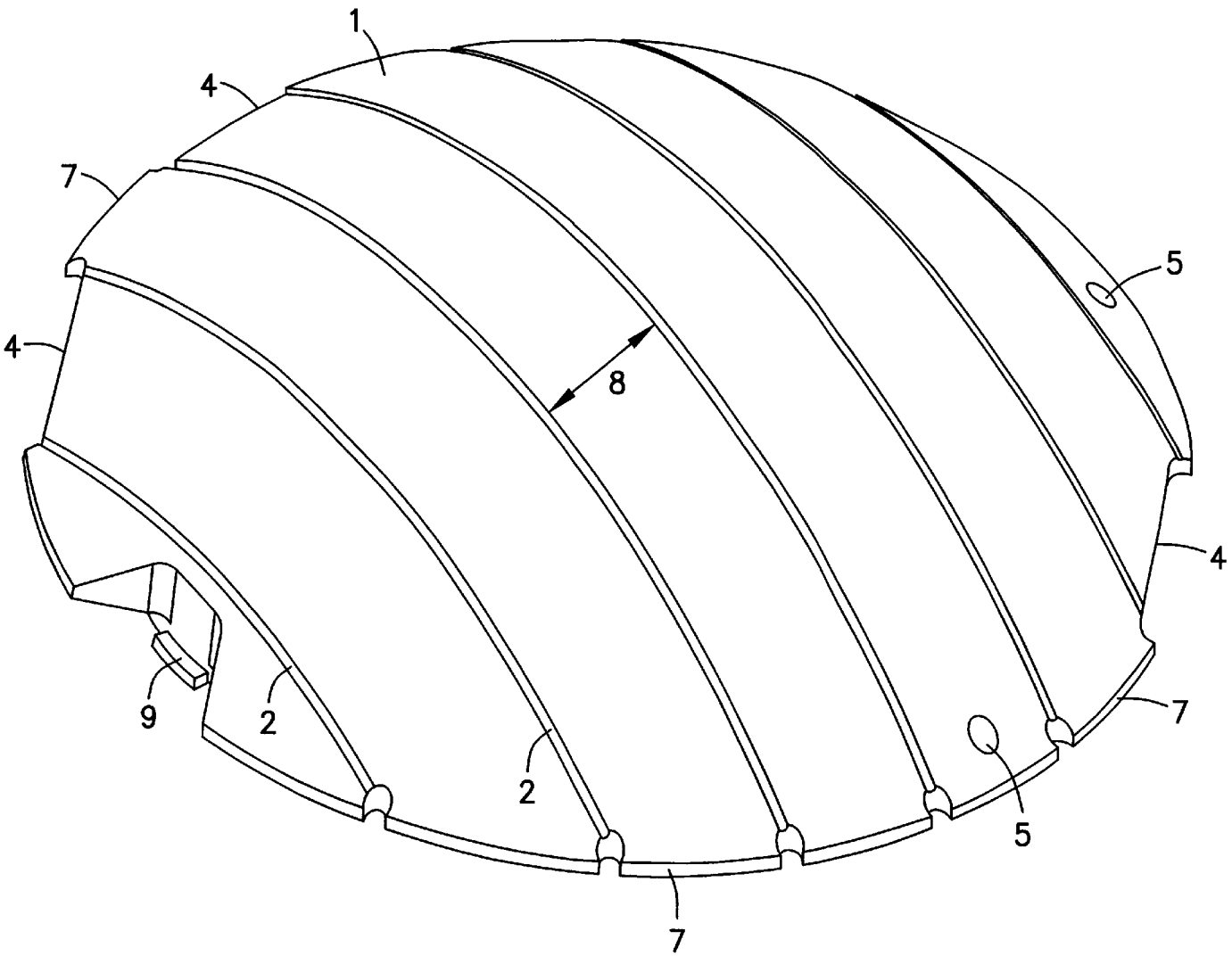
FIG. 1 shows a lens base element according to the present invention in a perspective depiction, from a side into which grooves are recessed.

FIG. 1 shows a lens base element 1 in a perspective depiction, from a side into which grooves 2 are recessed and, in this depiction, without electrically conductive traces 3 in place. Evident on the outer side (in this case, for example, convexly configured) of lens base element 1 are grooves 2, into which electrically conductive traces 3 are laid prior to an injection operation. Also depicted are indentations 4 (indentations 4 are explained below with respect to FIG. 2), recesses 5 (for the later introduction of clamping elements 6) and projections 7 (for fastening electrically conductive traces 3) on the outer edge of the lens. A detailed description of clamping elements 6 is provided below in conjunction with FIGS. 2 and 3.

In order for the sensor radiation to be able to pass through the antenna lens having electrically conductive traces 3 with as little influence as possible, it is advantageous to configure grooves 2 of lens base element 1, and thus also electrically conductive traces 3, predominantly perpendicular to the polarization direction of sensor radiation 8.

The desired focusing effect, in conjunction with the fastening of the electrically conductive traces, can also be implemented by way of antenna lenses with a different lens shape (for example, oval or rectangular), and/or by way of antenna lenses of other types (for example, concave or planar).

Further advantageous variations are to lay several independent electrically conductive traces into the lens base element, to lay electrically conductive traces having a non-constant spacing from the surface of the antenna lens into the lens base element, or to cause the electrically conductive traces to run at different levels within the antenna lens. A non-parallel profile of the grooves in the lens base element, or a non-constant spacing between the grooves in the lens base element, is also particularly advantageous.

Figure 2:
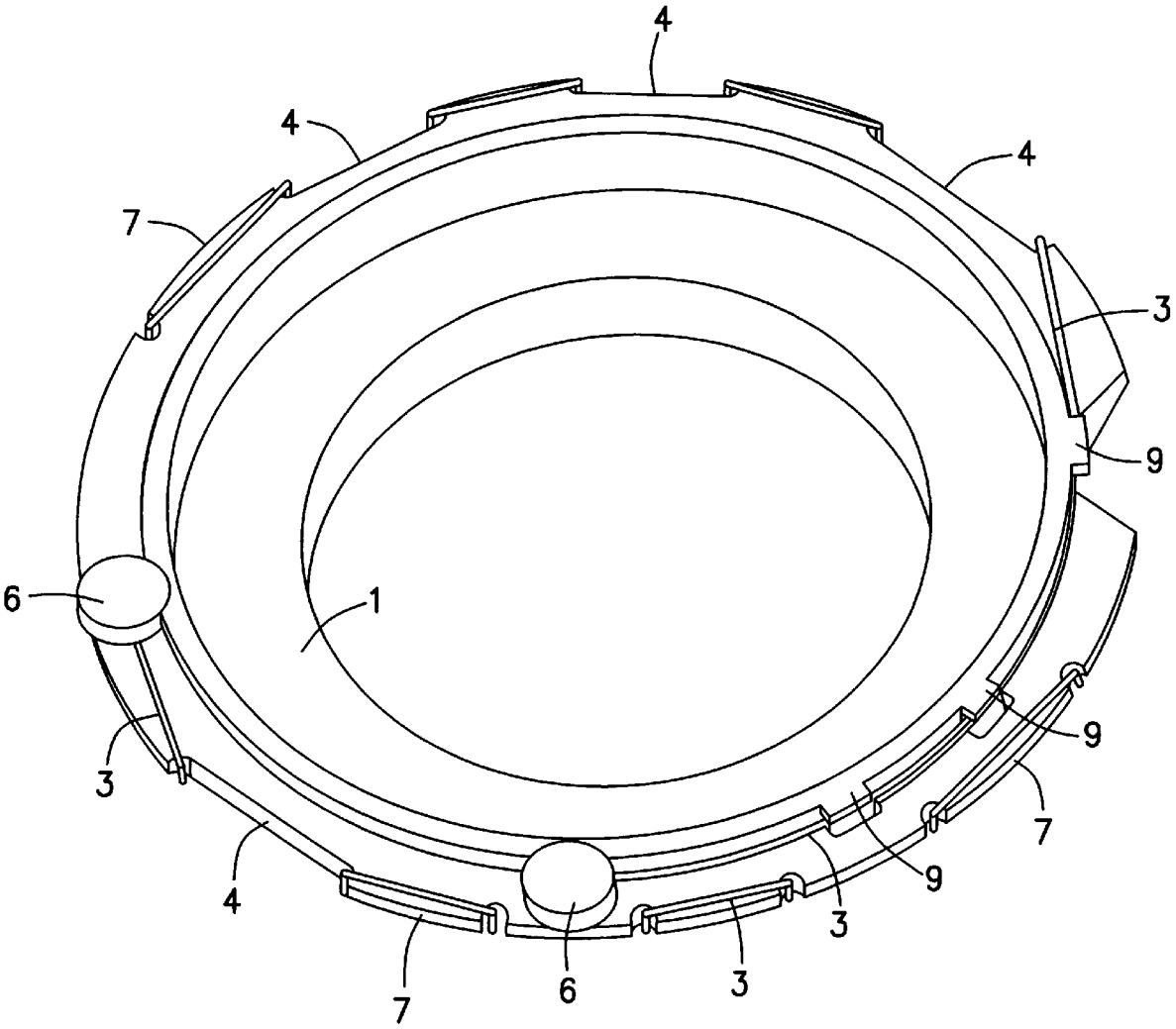
FIG. 2 shows a lens base element according to the present invention in a perspective depiction, viewed from the side facing away from the grooves, with electrically conductive traces laid in place and with clamping elements.

FIG. 2 shows lens base element 1 in a further perspective depiction, viewed from the side facing away from grooves 2, with electrically conductive traces 3 in place. It is evident in this perspective depiction that the electrically conductive traces 3, once laid in, are held on the convex outer side of lens base element 1 with the aid of fastening elements in the form of projections 7 on the outer edge of lens base element 1. Electrically conductive traces 3 emerging from a first groove 2 are guided around projections 7 and guided into an adjacent groove 2. This results in a meander-like layout of electrically conductive traces 3, as well as fastening within grooves 2. Also attached are fastening elements 9, which serve to fasten and guide electrically conductive traces 3 (after they are laid in meandering fashion into grooves 2 on the convex side of lens base element 1) on the side facing away from the convex side of the lens. Here again, guidance in a further groove (not depicted here) is also possible. Also shown are clamping elements 6 which are placed into recesses 5 depicted in FIG. 1. The function of these clamping elements 6 is explained in more detail below in the context of FIG. 3.

It is advantageous that fastening elements 9 on the side of lens base element 1 facing away from the grooves have a lesser spacing from the center of the antenna lens than projections 7 on the outer edge of the lens. The differing spacings of fastening elements 9 and projections 7 from the center of the antenna lens has the advantage that:, because of this non-intersecting layout, electrically conductive traces 3 cannot touch, and electrical short-circuiting is therefore ruled out.

Advantageously, projections 7 on the outer edge of the lens, fastening elements 9 on the side of lens base element 1 facing away from the grooves, and lens base element 1, are of integral configuration.

Also depicted are indentations 4 which can alternatively be configured at those points on the outer edge of lens base element 1, in the region between each two projections 7, at which no fastening of electrically conductive traces 3 to a projection 7 is necessary. These indentations 4 make possible easier placement of electrically conductive traces 3 into the corresponding grooves 2 of lens base element 1. Indentations 4 can already be correspondingly shaped in during manufacture. A mixed form made up of regions with indentations 4 and regions without indentations 4 can also be advantageous. Especially in the region of clamping elements 6, the omission of indentations 4 offers the advantage that clamping elements 6 can be arranged closer to the outer edge of lens base element 1, which prevents any influence on sensor radiation.

Figure 3:
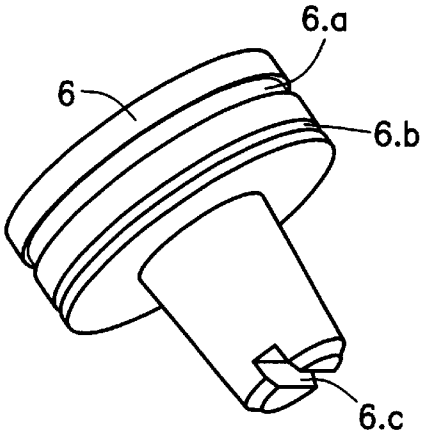
FIG. 3 shows a clamping element according to the present invention in a perspective depiction.

FIG. 3 shows a clamping element 6 for electrically conductive traces 3. A configuration such that at least one clamping element 6 is rotatably mounted is particularly advantageous. This is achieved by way of a, for example, rotationally symmetrical shape for clamping element 6. It is advantageous for the manufacturing process, in this context, if all clamping elements 6 are of identical configuration.

Also evident is a first channel 6.*a* on the circumference of clamping element 6, which provides secure positioning during injection-filling in a further injection operation. A second channel 6.*b*, which is also located on the circumference, is used for tensioning electrically conductive traces 3, which are guided to clamping elements 6 via fastening elements 9 on the side of lens base element 1 facing away from grooves 2. Attachment of electrically conductive traces 3 to clamping elements 6 can be accomplished, for example, by crimping, welding, or soldering in second channel 6.*b*. By rotating clamping elements 6 with electrically conductive traces 3 attached thereto, electrically conductive traces 3 are tensioned and fastened in position. With this tensioning operation it is also possible to compensate for manufacturing-related length tolerances in electrically conductive traces 3. The energy transfer for tensioning is accomplished via a slot 6.*c* which is reachable through recesses 5 in lens base element 1 from the convex outer side of the antenna lens.

Further variants, besides the channels, for securing electrically conductive traces 3 in position and tensioning them may be advantageous. Bore holes in the clamping elements, for example, could also perform these tasks.

According to a preferred embodiment, an electrically conductive connection exists between electrically conductive traces 3 and clamping elements 6. Clamping elements 6 serve in this context as contact elements through which electrical energy can be conveyed to electrically conductive traces 3. Electrical energy can be conveyed, for example, through spring elements (not depicted here). As a result, electrically conductive traces 3, through which current passes, can serve as a heating system which removes snow and ice from the surface of the antenna lens and dries off any moisture deposits which occur.

If at least a portion of the electrically conductive traces forms a time-delay line, functional testing of the distance sensor can be performed based on a target simulation. For this, a sensor pulse is fed into this line, and, in the case of a bistatic sensor system, is coupled into a receiving antenna after passing through the line. In a monostatic system, the line is terminated in reflecting fashion at one end, and the pulse that is fed in is bounced back toward a combined antenna. Because the signal transit time of the line is known in each case, a control signal is thereby obtained.

Figure 4:
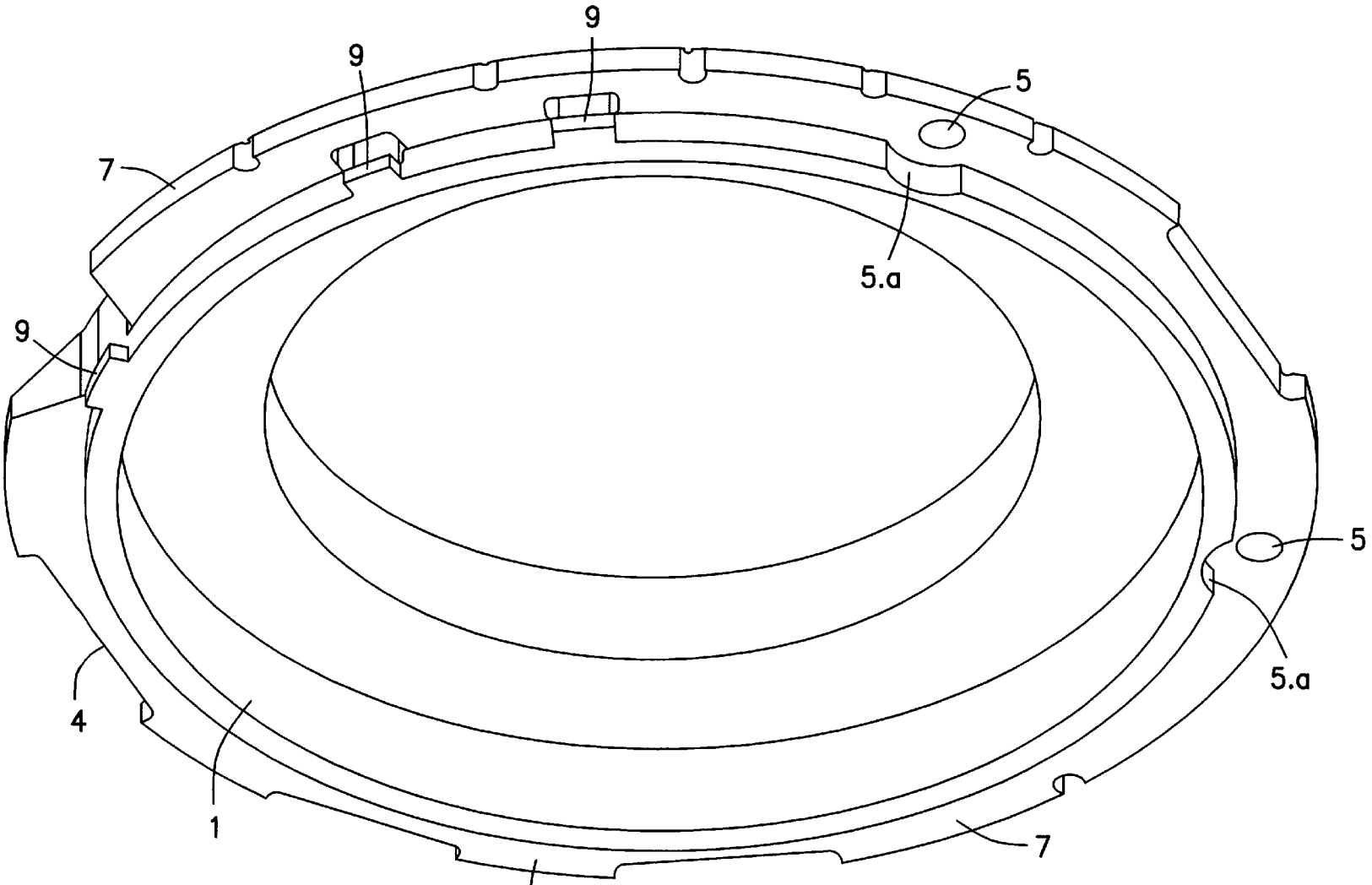
FIG. 4 shows a lens base element according to the present invention in a perspective depiction, viewed from the side facing away from the grooves.

FIG. 4 shows lens base element 1 without electrically conductive traces 3 in place, in a perspective depiction viewed from the side facing away from grooves 2. This view shows recesses 5, lying in the region of the outer edge of the lens, which correspond to the depiction in FIG. 1. In order to allow space-saving and secure attachment of clamping elements 6, lens base element 1 possesses, in the region of recesses 5, bulges 5.*a* which are adapted to the contour of clamping elements 6. By way of these bulges 5.*a* and channel 6.*a*, clamping elements 6 are secured in their position within recesses 5 during injection-filling in a further injection operation.

Figure 5:
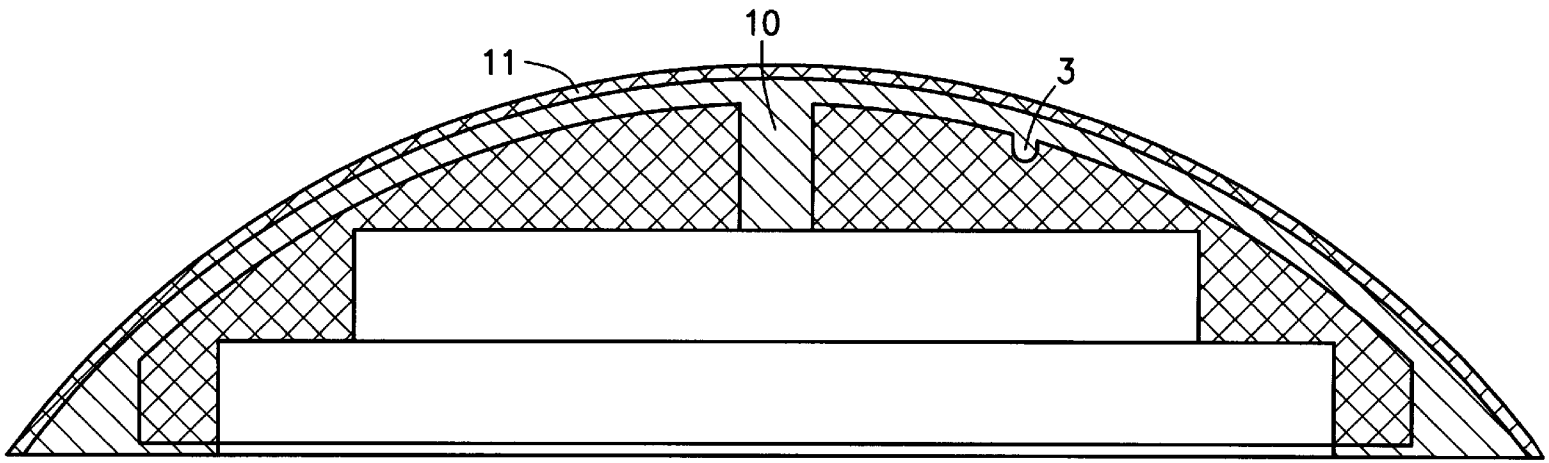
FIG. 5 shows an antenna lens according to the present invention, in a sectioned depiction parallel to the optical axis of the antenna lens.

FIG. 5 shows the antenna lens in a sectioned depiction parallel to the optical axis of the antenna lens. For a subsequent injection operation, it is advantageous that lens base element 1 possesses a hole 10 (not depicted in the previous Figures) through which a further antenna lens structure can be molded. This makes possible a homogeneous surface, free of air inclusions, for the further antenna lens structure. Hole 10 can, as depicted here by way of example, be arranged in the center of lens base element 1 and can be of cylindrical shape. It may also be advantageous for the subsequent injection operation, however, to arrange hole 10 asymmetrically and to configure it, for example, conically (tapering in the direction of the side of lens base element 1 having grooves 2). According to an advantageous embodiment, a protective film 11, which is tinted and/or colored (for example in body color) and/or has a surface structure (for example a scratch-proof surface) corresponding to the later utilization conditions of the antenna lens, can be laid into an injection-molding die before the injection operation. Better adaptation of the radar radiation can be achieved in this fashion than by way of a subsequent thin surface treatment or injection-filling of the antenna lens alone without a film. By way of example, one electrically conductive trace 3 is also shown in its final injection-embedded position inside the antenna lens.

It is particularly advantageous to injection-mold twist-preventers (in the form, for example, of cutouts) and assembly mounts (in the form, for example, of clips) onto the antenna lens by way of the further injection operation (not depicted here). As a result of these, upon adhesive bonding into a subsequent housing or housing part, contact with the mating piece is possible only when the antenna lens has been rotated correctly into position and the assembly mounts have snapped into place. This constitutes a particularly exact, quick, and economical assembly operation for the antenna lens. Further alignment of the antenna lens is not necessary.

What is claimed is:

1. An antenna lens for a distance sensor, comprising:

a lens base element having a first side and an edge, the first side having grooves recessed therein;

electrically conductive traces situated within the grooves, the traces passing through the grooves over the edge of the lens base element and being fastened to the lens base element;

fastening elements including projections situated on the edge of the lens base element for fastening the traces; and further fastening elements for fastening the traces, the further fastening elements being closer to a center of the lens base element than the projections, the further fastening elements being situated on a second side of the lens base element facing away from the grooves.

2. The antenna lens according to claim 1, wherein the fastening elements and the further fastening elements are integral with the lens base element.

3. An antenna lens for a distance sensor, comprising:

a lens base element having a first side and an edge, the first side having grooves recessed therein;

electrically conductive traces situated within the grooves, the traces passing through the grooves over the edge of the lens base element and being fastened to the lens base element; and clamping elements for fastening the traces situated on a second side of the lens base element facing away from the grooves.

4. The antenna lens according to claim 3, wherein the lens base element has at least two recesses lying in a region of the edge of the lens base element, the at least two recesses receiving the clamping elements.

5. The antenna lens according to claim 3, wherein the clamping elements have an electrically conductive connection to the traces and serve as contact elements through which electrical energy is conveyed to the traces.

6. The antenna lens according to claim 3, wherein at least one of the clamping elements is rotatably mounted.

7. The antenna lens according to claim 3, wherein the clamping elements have at least one channel providing a tensioning and a length compensation for the traces.

8. An antenna lens for a distance sensor, comprising:

a lens base element having a first side and an edge, the first side having grooves recessed therein; and electrically conductive traces situated within the grooves, the traces passing through the grooves over the edge of the lens base element and being fastened to the lens base element.

9. The antenna lens according to claim 8, further comprising fastening elements including projections situated on the edge of the lens base element for fastening the traces.

10. The antenna lens according to claim 8, wherein the lens base element has at least two indentations on the edge of the lens base element.

11. The antenna lens according to claim 8, wherein the grooves of the lens base element extend substantially perpendicular to a polarization direction of a sensor radiation passing through the antenna lens.

12. The antenna lens according to claim 8, wherein the grooves have a non-constant spacing from a lens surface.

13. The antenna lens according to claim 8, wherein the grooves have a non-constant spacing from a respective adjacent one of the grooves.

14. The antenna lens according to claim 8, wherein the traces serve as a heating system.

15. The antenna lens according to claim 8, wherein the traces serve as a time-delay line for checking a functionality of the distance sensor.

16. The antenna lens according to claim 8, further comprising a film on a surface of the antenna lens.

17. The antenna lens according to claim 16, wherein the film has a scratch-proof protective layer as a surface.

18. The antenna lens according to claim 16, wherein the film is tinted.

19. The antenna lens according to claim 16, wherein the film is colored.

20. The antenna lens according to claim 16, wherein the film is tinted and colored.

* * * * *